US008464840B2

(12) United States Patent
Flynn et al.

(10) Patent No.: US 8,464,840 B2
(45) Date of Patent: Jun. 18, 2013

(54) SECURITY-BASED ELEVATOR CONTROL TO ADDRESS A SECURITY VIOLATION INVOLVING AT LEAST ONE ELEVATOR CAR AT A LANDING

(75) Inventors: Michael P. Flynn, Avon, CT (US); Leslie Earl Grey, Windsor, CT (US); Jerrold C. Bloom, Windsor, CT (US)

(73) Assignee: Otis Elevator Company, Farmington, CT (US)

( * ) Notice: Subject to any disclaimer, the term of this patent is extended or adjusted under 35 U.S.C. 154(b) by 337 days.

(21) Appl. No.: 12/990,857

(22) PCT Filed: Jun. 30, 2008

(86) PCT No.: PCT/US2008/068706

§ 371 (c)(1),
(2), (4) Date: Nov. 3, 2010

(87) PCT Pub. No.: WO2010/002378

PCT Pub. Date: Jan. 7, 2010

(65) Prior Publication Data

US 2011/0048865 A1 Mar. 3, 2011

(51) Int. Cl.
*B66B 1/20* (2006.01)

(52) U.S. Cl.
USPC ..... 187/384; 187/391

(58) Field of Classification Search
USPC ..... 187/247, 248, 380–389, 391–393, 187/396
See application file for complete search history.

(56) References Cited

U.S. PATENT DOCUMENTS

| | | | | |
|---|---|---|---|---|
| 4,157,133 | A * | 6/1979 | Corcoran et al. | 187/384 |
| 4,341,288 | A * | 7/1982 | Bass | 187/384 |
| 4,979,594 | A | 12/1990 | Begle et al. | |
| 5,159,163 | A * | 10/1992 | Bahjat et al. | 187/381 |
| 5,200,583 | A * | 4/1993 | Kupersmith et al. | 187/384 |
| 5,317,114 | A | 5/1994 | Pullela et al. | |
| 5,932,853 | A | 8/1999 | Friedli et al. | |
| 6,707,374 | B1 * | 3/2004 | Zaharia | 340/5.31 |
| 7,093,693 | B1 * | 8/2006 | Gazdzinski | 187/384 |
| 7,190,256 | B2 * | 3/2007 | Pieper | 340/5.7 |
| 7,529,646 | B2 * | 5/2009 | Lin et al. | 702/188 |
| 7,581,622 | B2 * | 9/2009 | Amano | 187/384 |
| 8,061,485 | B2 * | 11/2011 | Finschi | 187/384 |
| 8,151,943 | B2 * | 4/2012 | de Groot | 187/382 |
| 2004/0262093 | A1 | 12/2004 | Forsythe et al. | |
| 2012/0160613 | A1 * | 6/2012 | Friedli | 187/384 |

(Continued)

FOREIGN PATENT DOCUMENTS

| | | | |
|---|---|---|---|
| EP | 1707526 | A1 | 10/2006 |
| JP | 01236184 | A * | 9/1989 |

(Continued)

OTHER PUBLICATIONS

Translation Abstract JP 01236184 A.*

(Continued)

*Primary Examiner* — Anthony Salata
(74) *Attorney, Agent, or Firm* — Carlson, Gaskey & Olds PC

(57) ABSTRACT

An exemplary method of controlling a plurality of elevator cars includes determining that there is a security violation condition involving at least one of the elevator cars at a landing. That elevator car is prevented from moving from the landing until the condition is resolved. The other elevator cars are controlled such that they do not provide elevator service to or from the landing until the condition is resolved.

18 Claims, 2 Drawing Sheets

U.S. PATENT DOCUMENTS

2012/0241259 A1* 9/2012 Flynn et al. ..... 187/384

FOREIGN PATENT DOCUMENTS

| | | | | |
|---|---|---|---|---|
| JP | 04197976 | A | * | 7/1992 |
| JP | 9216773 | A | | 8/1997 |
| JP | 2000255915 | A | | 9/2000 |
| JP | 2001270665 | A | | 10/2001 |
| JP | 2008143686 | A | | 6/2008 |
| WO | 2008046173 | A1 | | 4/2008 |

OTHER PUBLICATIONS

International Search Report and Written Opinion of the International Searching Authority for International application No. PCT/US2008/068706 mailed Mar. 27, 2009.

International Preliminary Report on Patentability for International application No. PCT/US2008/068706 mailed Jan. 13, 2011.

* cited by examiner

SECURITY-BASED ELEVATOR CONTROL TO ADDRESS A SECURITY VIOLATION INVOLVING AT LEAST ONE ELEVATOR CAR AT A LANDING

BACKGROUND

Elevator systems provide a convenient way to transport passengers between different levels in a building. In most situations, there are very limited, if any, restrictions on individuals using elevators, provided that they are in service. There are some situations, however, where particular elevator system control is useful for security purposes.

For example, in some settings, it is desirable to limit who can use an elevator to leave a particular area or floor of a building. A hospital setting is one example. It has become desirable to provide security in post-natal areas of hospitals to ensure that babies are only taken home by a parent or another authorized individual. Another example hospital setting is on a floor where mentally ill patients should not be allowed to leave a particular area without an appropriate escort, for example.

Other situations involving security conditions exist. For example, incarcerated individuals may need to appear in court. It is desirable to prevent such an individual from freely moving about within a courthouse without an appropriate authoritative individual accompanying the incarcerated individual.

Another example involves restricted areas within businesses that are only accessible to authorized individuals. Elevators may be used to control such access. It would be useful to be able to control elevator systems to address such situations where such security concerns arise.

SUMMARY

An exemplary method of controlling a plurality of elevator cars includes determining that there is a security violation condition involving at least one of the elevator cars at a landing. That elevator car is prevented from moving from the landing until the condition is resolved. The other elevator cars are controlled such that they do not provide elevator service to or from the landing until the condition is resolved.

An exemplary elevator system includes a plurality of elevator cars. A controller determines that there is a security violation condition involving at least one of the elevator cars at a landing. The controller responsively prevents that elevator car from moving from the landing until the condition is resolved. The controller also provides an indication for controlling the other elevator cars such that they do not provide elevator service to or from the landing until the condition is resolved.

The various features and advantages of the disclosed example will become apparent to those skilled in the art from the following detailed description. The drawings that accompany the detailed description can be briefly described as follows.

DETAILED DESCRIPTION

Figure 1:
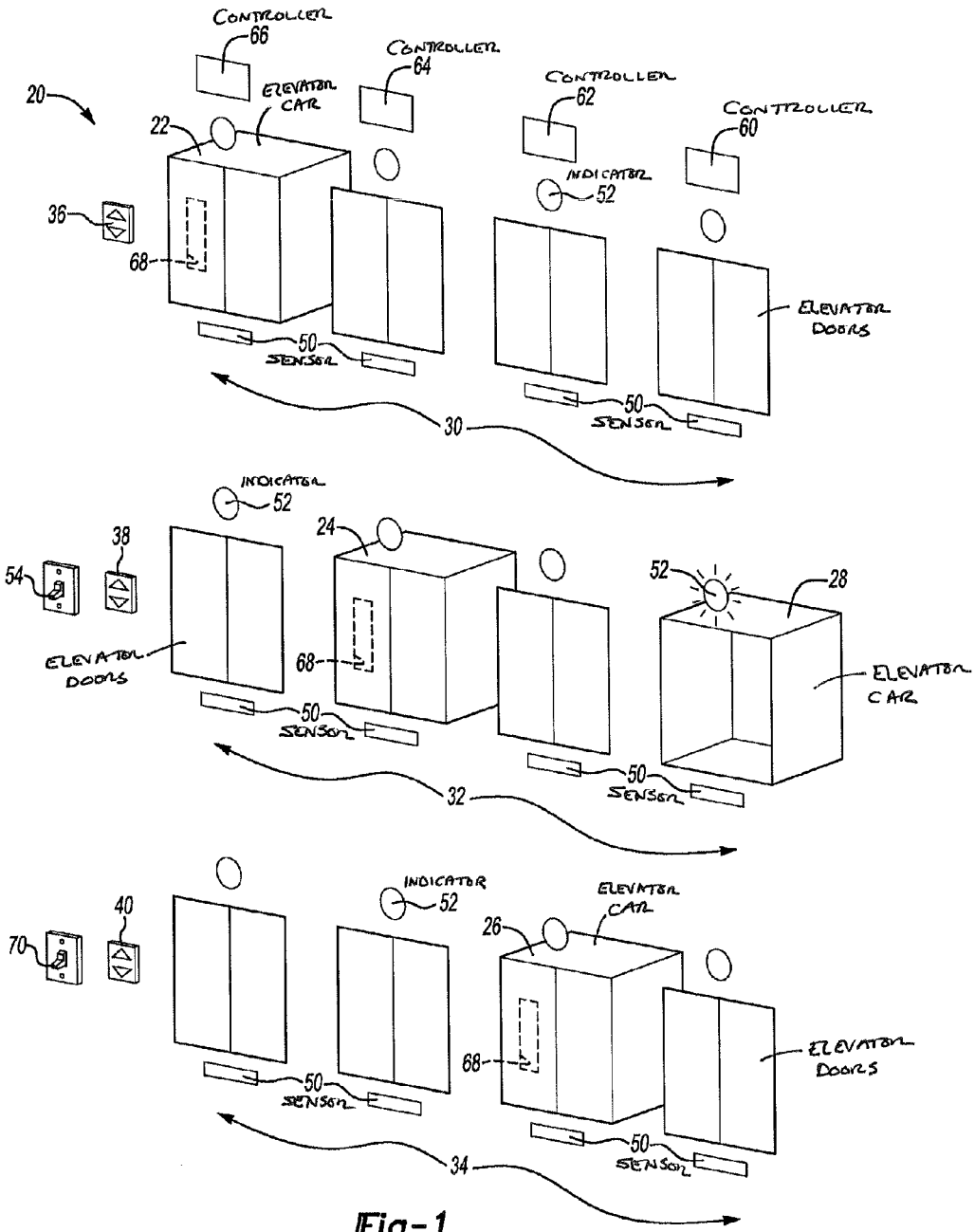
FIG. 1 schematically illustrates selected portions of an example elevator system designed according to an embodiment of this invention.

FIG. 1 schematically shows selected portions of an elevator system 20. A plurality of elevator cars 22, 24, 26 and 28 are supported within corresponding hoistways, for example, to provide elevator service in a generally known manner under normal circumstances. In the example of FIG. 1, the elevator car 22 is parked at a landing 30 to provide elevator service between that landing and another location in a corresponding building, for example. The elevator cars 24 and 28 are parked at another landing 32. The elevator car 26 in this example is parked at a landing 34. In the illustrated example, each of the elevator cars is normally capable of providing service at any of the landings 30, 32 or 34.

The example elevator system 20 is designed to address a security violation condition that involves unauthorized access to or use of one of the elevator cars, for example. The security condition may be one in which an individual attempts to enter or leave a particular area using one of the elevator cars without appropriate authorization. This may apply to a post-natal hospital setting, a mental health facility, a government building such as a courthouse or a private business in which security is required to protect particular individuals or information, for example.

Individuals can use hall call buttons 36 at the landing 30 to request service to another building level. Similarly, hall call buttons 38 and 40 allow for requesting service from the landings 32 and 34, respectively.

In the example of FIG. 1, a sensor 50 is associated with the access to each elevator car at each landing. The sensors 50 comprise known devices in one example that are capable of detecting the presence of a corresponding known triggering or signaling device as an individual wearing or carrying such a device crosses a corresponding threshold of an elevator car, for example. If an incarcerated individual is wearing a tether with a tracking device, for example, the sensor 50 will detect when such an individual crosses a threshold between a landing and one of the elevator cars. If a baby or small child wears a patient identification band with an associated signaling device, the sensors 50 will detect when the device crosses a threshold of a corresponding elevator car.

A plurality of indicators 52 are schematically shown associated with each access point (e.g., hoistway doors) to the elevator cars. The indicators 52 in one example provide at least one of a visible or audible indication in the event that a corresponding sensor 50 detects unauthorized use of a corresponding elevator car.

For purposes of discussion, the elevator car 28 will be considered to be one that is accessed in an unauthorized manner giving rise to a security violation condition. The sensor 50 has detected an unauthorized access to the elevator car 28, which is at the landing 32 with its doors open. The corresponding indicator 52 provides an indication regarding the security violation condition.

In the example of FIG. 1, a manually controllable device schematically shown as a switch 54 allows an individual to manually provide an indication regarding the unauthorized access to the elevator car 28. For example, a nurse at a nurse's station that can see the elevator lobby at the landing 32 may be able to manipulate a switch to indicate that an unauthorized individual has approached or entered the elevator car 28. The manual activation of the device 54 may be used in combination with operation of the sensors 50.

Once the security violation condition has been detected, a controller 60 of the elevator car 28 prevents the elevator car 28 from leaving the landing 32 until an authorized individual resets the controller 60 to operate in a normal service mode. Once the security violation condition is resolved such as by apprehending an individual attempting to improperly leave the floor of the landing 32, an authorized individual can reset the controller 60 so that the elevator car 28 can resume normal service operation. While there is a security condition, however, the elevator car 28 is prevented from moving from the landing 32. This type of control facilitates prohibiting an individual from improperly leaving or being taken from an area, for example.

In one example, the doors of an elevator car involved in a security violation condition are held open until the situation is resolved.

Once the security violation condition is determined to exist, the controller 60 not only controls operation of the car 28. In this example, the controller 60 also provides an indication to controllers 62, 64 and 66, which are each respectively responsible for controlling operation of the other elevator cars 26, 24 and 22, respectively. In this example, the other elevator cars are allowed to continue to operate to provide passenger service between various levels within the building with the exception of the landing 32 because that is where the security violation condition has been determined to exist. The elevator car 22, for example, is controlled by the controller 66 so that it may travel between the landings 30 and 34 without stopping at the landing 32. Similarly, the elevator car 26 is allowed to travel to various landings other than the landing 32. Such control prevents an individual from utilizing another one of the elevator cars because the elevator car 28 has effectively been taken out of operation given the determination regarding the security condition.

The elevator car 24 in this example is parked at the same landing 32 where the security violation condition has occurred. In one example, the elevator car 24 is prevented from leaving the landing 32 until the security condition is resolved. If the elevator car 24 has its doors open at the landing 32 when the condition is detected, the doors are controlled to remain open and the elevator car 24 is controlled to remain at the landing 32. If the car doors of the elevator car 24 were closed, however, in some examples, the car is allowed to leave the landing 32 to provide elevator service among other landings.

The controllers 62, 64 and 66 respond to an indication of the security violation condition by leaving a normal service mode and entering a security condition service mode that includes limited use of the elevator cars based on an indication of where the security condition has occurred. The controller 60, for example, knows or determines the location of the car 28 and provides an indication of that to the other controllers as part of the communication regarding the security violation condition.

In the illustrated example, the hall call buttons 36, 38 and 40 are also controlled in a security mode when there is a security violation condition. The hall call functionality of the hall call buttons 38 in one example is disabled once the security condition at the landing 32 has been detected. This prevents any other elevator car from being scheduled to stop at the landing 32 in response to a hall call placed once a determination is made that there is a security violation condition at that landing. The hall call buttons 36 and 40 may remain functional to allow an individual to request service at the corresponding landings. The controllers 62, 64 and 66 appropriately control whether their corresponding elevator car will respond to such a service request.

In the example of FIG. 1, each elevator car includes a car operating panel 68 inside of the car that allows an individual to request service to a particular destination. During a security violation condition, the example car operating panels 68 enter a security operating mode in which the functionality of the car operating panels is limited compared to a normal operating mode. For example, none of the car operating panels 68 will allow for an individual to request service to the landing 32 when the security condition is in effect at that landing.

The example of FIG. 1 includes an override device schematically shown as a switch 70 that allows an authorized individual to override the security functionality provided by the controllers 60, 62, 64 and 66 to control operation of one or more of the elevator cars to facilitate authorized individuals addressing the security condition. For example, it may be possible for an authorized individual to override the limited functionality of a car operating panel to have one of the elevator cars carry such an individual to the landing 32 where that individual can address the security condition, for example. While only one override device 70 is shown in FIG. 1, a plurality of such devices may be strategically located relative to other components of the elevator system. In some examples, the controllers 60-66 are configured to respond to communications from a portable device such as a notebook computer or cell phone that provides an appropriate override signal.

Communications between the controllers 60-66 and the other components of the example elevator system 20 may occur over line-based connections or through wireless communications, for example. Specific communication links between the various devices is not shown in the drawing. Those skilled in the art who have the benefit of this description will realize how to configure an appropriate communication arrangement to meet their particular needs for realizing the security features of the disclosed example.

Figure 2:
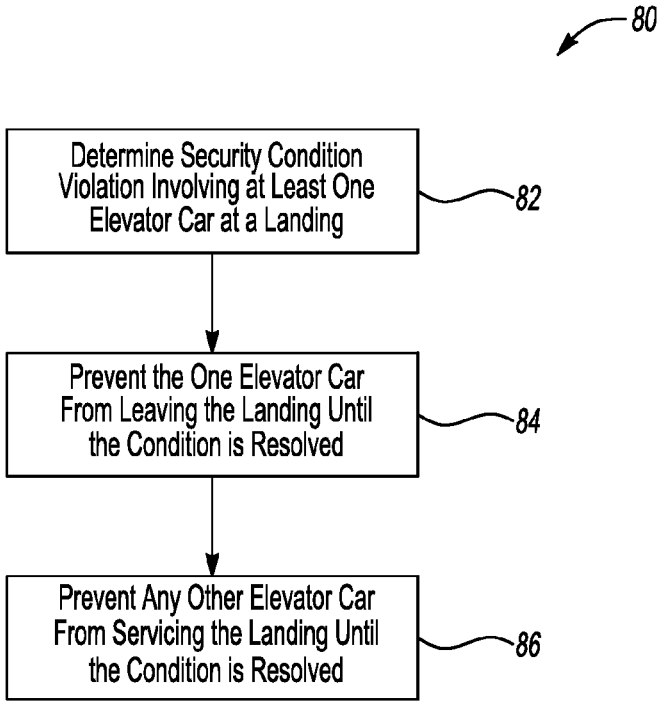
FIG. 2 is a flowchart diagram summarizing one example approach.

FIG. 2 includes a flowchart diagram 80 summarizing one example approach. At 82, a determination is made that a security condition violation involves at least one elevator car at a landing. At 84, the one elevator car is prevented from leaving that landing until the condition is resolved. In one example, that elevator car remains at the landing with the doors open. At 86 any other elevator car is prevented from servicing that landing until the condition is resolved. In some cases where an elevator car is already at the landing of interest, that car remains at that landing. Other cars that are not at the landing of concern are allowed to continue providing service between and among other landings as described above.

Any one of the controllers 60-66 can operate as a master controller in the event that the corresponding elevator car is the one involved in the security violation condition. Any one of the controllers can provide an indication to other controllers so that all elevator cars operate in a security mode until a particular condition is resolved. Depending on where the security violation condition has occurred and the location of the responsive elevator cars, the different controllers will determine which way to respond to the security condition and operate accordingly. Each of the controllers 60-66 is individually programmed with appropriate parameters to realize a normal operating function under most circumstances and a security operation function whenever a security violation condition exists.

In the example described above, the individual controllers communicate with each other. In another example, a master dispatch controller dictates the operation of each car directly or through appropriate signaling to the controllers. The various elevator control functions used in the disclosed examples may be coordinated among multiple controllers or a single controller to meet the needs and configuration of a particular elevator system.

The preceding description is exemplary rather than limiting in nature. Variations and modifications to the disclosed examples may become apparent to those skilled in the art that do not necessarily depart from the essence of this invention.

The scope of legal protection given to this invention can only be determined by studying the following claims.

We claim:

1. A method of controlling a plurality of elevator cars, comprising the steps of:

determining that there is a security violation condition involving at least one of the elevator cars at a landing;

communicating an indication of the determined security violation condition to a controller associated with each of the other ones of the plurality of elevator cars;

preventing the one of the elevator cars from moving from the landing until the condition is resolved; and controlling other ones of the plurality of elevator cars such that the other elevator cars do not provide elevator service to or from the landing until the condition is resolved.

2. The method of claim 1, comprising controlling any other of the elevator cars currently at the landing with an open door to remain at the landing until the condition is resolved.

3. The method of claim 1, comprising controlling any other of the elevator cars not currently at the landing to not stop at the landing until the condition is resolved.

4. The method of claim 1, comprising subsequently communicating an indication that the condition is resolved such that the controllers return to a normal operating state.

5. The method of claim 1, comprising disabling a hall call function at the landing responsive to the determined security violation at the landing.

6. The method of claim 1, comprising disabling a car call function in each of the other ones of the elevator cars to prevent a call for service at the landing from being placed in each of the other ones of the elevator cars during the determined security violation condition.

7. A method of controlling a plurality of elevator cars, comprising the steps of:

determining that there is a security violation condition involving at least one of the elevator cars at a landing;

preventing the one of the elevator cars from moving from the landing until the condition is resolved;

controlling other ones of the plurality of elevator cars such that the other elevator cars do not provide elevator service to or from the landing until the condition is resolved; and selectively overriding control of a selected one of the plurality of elevator cars to allow an authorized individual to direct the selected elevator car to the landing during the security violation condition.

8. The method of claim 1, comprising detecting an unauthorized access of the at least one of the elevator cars at the landing.

9. The method of claim 1, comprising receiving an indication of the security violation condition from a manually accessible security device.

10. An elevator system, comprising:

a plurality of elevator cars;

a controller that determines that there is a security violation condition involving at least one of the elevator cars at a landing, the controller responsively prevents the one of the elevator cars from moving from the landing until the condition is resolved and provides an indication for controlling other ones of the plurality of elevator cars such that the other elevator cars do not provide elevator service to or from the landing until the condition is resolved; and wherein any other of the elevator cars currently at the landing with an open door remain at the landing until the condition is resolved.

11. The system of claim 10, wherein any other of the elevator cars not currently at the landing are prevented from stopping at the landing until the condition is resolved.

12. An elevator system, comprising:

a plurality of elevator cars;

a controller that determines that there is a security violation condition involving at least one of the elevator cars at a landing, the controller responsively prevents the one of the elevator cars from moving from the landing until the condition is resolved and provides an indication for controlling other ones of the plurality of elevator cars such that the other elevator cars do not provide elevator service to or from the landing until the condition is resolved; and a plurality of other controllers, each being associated with one of the elevator cars and wherein the controller provides the indication to the other controllers such that each of the other controllers receives an indication of the determined security violation condition.

13. The system of claim 12, wherein at least one of the controllers subsequently communicates an indication that the condition is resolved to at least one other of the controllers; and the at least one other of the controllers responsively returns to a normal operating state.

14. An elevator system, comprising:

a plurality of elevator cars;

a controller that determines that there is a security violation condition involving at least one of the elevator cars at a landing, the controller responsively prevents the one of the elevator cars from moving from the landing until the condition is resolved and provides an indication for controlling other ones of the plurality of elevator cars such that the other elevator cars do not provide elevator service to or from the landing until the condition is resolved; and at least one hall call fixture at the landing configured to perform a hall call function for requesting elevator service at the landing and wherein the hall call function of the fixture is disabled responsive to the determined security violation at the landing.

15. The system of claim 12, comprising a car operating panel in each of the plurality of elevator cars and wherein a car call function of each car operating panel is disabled to prevent a call for service at the landing from being placed in each of the other ones of the elevator cars during the determined security violation condition.

16. The system of claim 12, comprising at least one override switch for selectively overriding control of a selected one of the plurality of elevator cars to allow an authorized individual to direct the selected elevator car to the landing during the security violation condition.

17. The system of claim 12, comprising at least one sensor that detect an unauthorized access of the at least one of the elevator cars at the landing.

18. An elevator system, comprising:

a plurality of elevator cars;

a controller that determines that there is a security violation condition involving at least one of the elevator cars at a landing, the controller responsively prevents the one of the elevator cars from moving from the landing until the condition is resolved and provides an indication for controlling other ones of the plurality of elevator cars such that the other elevator cars do not provide elevator service to or from the landing until the condition is resolved; and a manually accessible security device that is configured to provide an indication of the security violation condition to the controller.

* * * * *